United States Patent [19]

Windal et al.

[11] 4,177,326

[45] Dec. 4, 1979

[54] PROCESS FOR COATING STAINLESS STEEL WITH A LEAD-BASED ALLOY AND ARTICLE

[75] Inventors: Bernard A. M. Windal; Edmond Lobry, both of Solesmes, France

[73] Assignee: VALLOUREC Usines a Tubes de Lorraine-Escaut et Vallourec Reunies, Paris, France

[21] Appl. No.: 861,480

[22] Filed: Dec. 16, 1977

[30] Foreign Application Priority Data

Dec. 17, 1976 [FR] France ..... 76 38192

[51] Int. Cl.[2] ..... C23C 1/06

[52] U.S. Cl. ..... 428/645; 427/319; 427/329; 427/433; 148/12 E; 148/15; 148/12.1

[58] Field of Search ..... 427/319, 320, 329, 321, 427/433; 148/12 E, 12 EA, 12 D, 15, 20, 135, 136; 428/645

[56] References Cited

U.S. PATENT DOCUMENTS

| | | | |
|---|---|---|---|
| 131,680 | 9/1872 | Hill | 148/15 |
| 399,382 | 3/1889 | Coffin | 427/321 |
| 2,111,826 | 3/1938 | Waltman et al. | 427/432 |
| 3,511,686 | 5/1970 | Withrow | 427/319 |

*Primary Examiner*—Ralph S. Kendall

*Attorney, Agent, or Firm*—Pollock, Vande Sande & Priddy

[57] ABSTRACT

The invention relates to a process and installation for making stainless steels coated with a lead-based alloy and having undergone annealing. The surface of the product is first prepared by mechanical treatment, then the product is pre-coated by known techniques such as hot tin-plating, after which the annealing treatment is effected, followed by the final coating. Such products may be used, inter alia, in the manufacture of car radiators.

8 Claims, 2 Drawing Figures

PROCESS FOR COATING STAINLESS STEEL WITH A LEAD-BASED ALLOY AND ARTICLE

Figure 1:
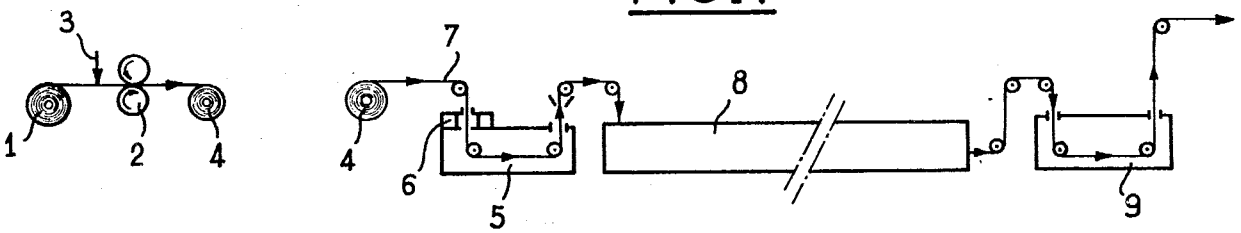

The present invention relates to a process for coating a steel product, particularly by tin-plating.

The invention concerns a process and installation enabling steels—and in particular certain stainless steels—to be coated with an alloy based on lead. It is more particularly applied to the production of stainless steels having undergone annealing and tin-plated with an alloy containing approximately 80% lead and 20% tin.

A particular industrial sector in which certain stainless steels find novel application is that of car radiators. In fact, for various reasons and particularly due to a more and more widespread use of sealed cooling circuits in which water circulates under pressure, it is becoming more advantageous to employ tubes made of stainless steel which, having a better mechanical resistance than the brass tubes which were used beforehand, may be used with smaller thicknesses.

In this type of application, stainless steels must be subjected to an annealing treatment rendering the steel sheets deformable, thus allowing their clamping, and be tin-plated for reasons of resistance to corrosion, but especially to allow the cooling fins to be assembled and the tubes to be water-tight.

It has previously been ascertained that it is not possible, industrially and economically, to plate an annealed stainless steel with tin or lead. This may be explained by the fact that annealed stainless steels have on their surface an extra-fine layer of oxides which is prejudicial to the constitution of the iron-tin or iron-antimony alloy, which support is indispensable for the coating. Consequently, they are unsuitable for undergoing coatings of tin-lead alloys or the like.

Prior art surface treatments proposed for allowing this type of coating are chemical or electrochemical picklings, which are operations delicate to carry out and which do not avoid the immediate formation of a further layer of oxide as soon as the pickled product is again in contact with the air. Consequently, continuous pickling on a coating line effecting tin-plating, leading or like treatment, requires complex installations which make satisfactory pricing difficult if not impossible. In addition, protection of the pickled surface is required between the pickling operation and the tin-plating or like operation.

It is an object of the present invention to provide a process and an installation which do not present the drawbacks of the prior art.

The invention relates to a process for coating a steel product, particularly stainless steel, with an alloy based on lead, wherein the surface is first prepared by a mechanical treatment, whereafter the product thus prepared is coated by conventional means, such as hot tin-plating.

The preparation of the surface, intended to eliminate the layer of oxide on the product, may for example, involve polishing or cold-rolling in a rolling mill. The rolling fluid is advantageously a mineral oil. Consequently, it is possible to produce a thin layer of an iron-tin alloy between the steel product constituting the substrate and the alloy based on lead and tin, constituting the coating, using a flux normally employed in tin-plating operations, such as zinc or ammonium chloride.

The product obtained, particularly when the surface preparation has been effected by reduction of thickness in the rolling mill, no longer presents the mechanical characteristics of an annealed steel, and must therefore undergo a heat treatment giving it the required properties of deformability.

According to a further feature of the invention, the annealing treatment is conducted after the product has been pre-coated as indicated hereinabove; a second coating operation is then carried out to give the final product the desired commercial appearance.

The annealing operation may be effected by passage in a tunnel furnace heated to a suitable temperature in a protective atmosphere. It is true that the coating melts during the heat treatment, but it assures the protection of the steel against oxidation and enables the annealed product to undergo a coating of tin-lead alloy during the second coating operation.

According to a preferred embodiment of the invention, a bath of the coating alloy, heated to suitable temperature, is used to assure the annealing treatment of the steel. The overall process therefore comprises an operation for the mechanical preparation on the surface of the steel product, in particular stainless steel, particularly by passage in the rolling mill, followed by the coating of the mechanically prepared product, with the aid of a bath of lead-based alloy, e.g., 80% lead and 20% tin taken to a suitable coating temperature, of the order of 340° to 380° C., followed by annealing by passage of the alloy-coated product in a bath of the same alloy heated to a suitable annealing temperature, of the order of 700° to 800° C. for a stainless steel of type Z 8 C 17, and finally a final coating operation by passage of the annealed product in a bath of the same coating alloy taken to a temperature enabling a product of the desried commercial appearance to be obtained.

The invention also relates to the installations for carrying out the process and, more particularly, to the part of the production line which processes the product previously coated with the alloy based on lead to undergo annealing and the final coating therein. This part comprises three successive sections communicating with one another by separating elements allowing the passage of the product immersed in the alloy bath, the first section being equipped with means for heating the alloy bath to the coating temperature, the second section being equipped with means for heating the alloy bath to the annealing temperature and the third section, separated from the second by a separating element provided with cooling means, being equipped with means for heating the alloy bath to a temperature close to the coating temperature.

The invention will be more readily understood on reading the following description with reference to the accompanying drawings, in which:

FIG. 1 schematically shows one embodiment of the installation according to the invention.

Figure 2:
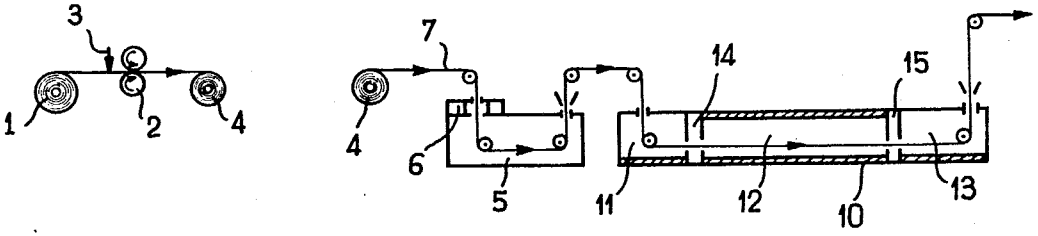

FIG. 2 schematically shows a second embodiment thereof.

Referring now to the drawings, the starting product made of stainless steel is referenced at 1 and is a roll of stainless steel strip. It is for example a stainless steel corresponding to AFNOR (French) standard No. A 35 572 according to designation Z 8 C 17 containing 17% chromium.

According to the invention, this product is subjected to mechanical treatment for preparing its surface. This treatment advantageously comprises a cold rolling in a rolling mill 2 with mineral oil or the like introduced at 3. After several passages in the rolling mill, a roll of cold-rolled steel 4 is obtained.

This product, having undergone mechanical surface preparation, is coated with a lead-based alloy, e.g., an alloy containing 80% lead and 20% tin. A hot tin-plating operation is preferably carried out by immersion in a bath heated to a temperature of between 340° and 380° C. and contained in a vat 5 after the product has been covered, at 6, by a flux based on zinc, ammonium or like chloride according to a known technique. The strip 7 which continuously passes through vat 5 is thus coated with the tin-plating alloy. A product made of stainless steel is obtained, which is tin-plated but in the cold-rolled state.

For the product to have the properties of malleability necessary for its industrial use, it must undergo an annealing treatment. According to the invention, this operation is effected after the coating which has just been described, i.e., the surface coating is used to protect the substrate against oxidation during the annealing operation.

In the first embodiment shown schematically in FIG. 1, the annealing treatment is effected by passage of the product through a tunnel furnace 8 heated in a reducing atmosphere to a suitable temperature, between 700° and 800° C. in the particular case envisaged. At this temperture, the coating melts; however, it sufficiently assures protection of the steel against oxidation to make it unnecessary to take particular precautions in this respect.

After this heat treatment, a second coating operation is effected by immersion of the product in a bath of the same alloy heated to the desired temperature, between 340° and b 380° C. and contained in a vat 9. This second coating, intended to assure the desired commercial appearance for the final product, is rendered possible by the pre-coating effected in the vat 5 before the heat treatment.

In a second, preferred embodiment which is shown schematically in FIG. 2, the heat treatment of the steel is assured by means of a bath of the coating alloy heated to the suitable annealing temperature. To this end, strip 7, having undergone the pre-coating in 5, moves to a vat 10 divided into three sections 11, 12 and 13 communicating with one another via separting elements 14 and 15 which may or may not be immersed in the alloy contained in the vat, so as to allow the passage of the product to be coated and treated thermally, while maintaining the sections at different temperatures.

The first section 11 is a pre-heating section. The alloy bath through which the product 7 passes is therefore maintained at the temperature necessary for this operation, viz. 340°–380° C. in the case of a coating with an alloy containing 80% lead and 20% tin. Via the separating element 14, the product passes into the second section 12 where the bath is heated to the temperature allowing the heat treatment necessary for obtaining the desired mechanical characteristics of the product, e.g., between 700° and 800° C. in the case of coating stainless steel Z 8 C 17. In this second section, whose outer walls are suitably protected against the oxidizing action, the heating may be assured by burners or by electrical means.

Via the second separating element 15 equipped with suitable cooling means, the product passes into the third section 13 heated to a temperature similar to that prevailing in the first section 11 and, in any case, enabling a desired commercial product to be obtained. In particular, the product is a strip of stainless steel in the annealed state having tin-plating or the like.

It should be noted that the process according to the invention may be applied to all alloys of lead-tin, lead-antimony, or lead-tin-antimony which may form with the substrate an alloy allowing the coating. The substrate is preferably a stainless steel, but other types of steel may be tin-plated, inter alia a mild or hard steel.

What is claimed is:

1. Process for manufacturing a strip of annealed stainless steel having a lead-based alloy coating, comprising (a) mechanically preparing the surface of a stainless steel strip by cold rolling to remove oxide therefrom;

(b) pre-coating said strip in a lead-based alloy bath;

(c) heat treating the pre-coated strip by passing it through a second bath of the same alloy at an annealing temperature suifficient to render it deformable; and (d) finally coating said strip by passing it through a third bath of the same alloy at a temperature lower than said annealing temperature.

2. The process of claim 1, wherein the mechanical preparation of said surface of said strip comprises polishing provoking a superficial cold-rolling.

3. The process of claim 1, wherein the mechanical preparation of said surface of said strip comprises a cold operation reducing the thickness of said strip and provoking cold-rolling in the mass.

4. The process of claim 1, wherein said steel is alloyed with chromium.

5. The process of claim 4, wherein said alloy contains 17% chromium.

6. The process of claim 1, wherein the coating alloy contains 80% lead and 20% tin.

7. The process of claim 6, wherein the temperature of the pre-coating bath and of the final coating bath is between 340° and 380° C., and the temperature of the bath for the annealing operation is between 700° and 800° C.

8. A product made of annealed stainless steel, the surface of which is coated with a protective lead-based alloy, obtained by the process of claim 1.

* * * * *